United States Patent [19]

Allen

[11] Patent Number: 4,993,172

[45] Date of Patent: Feb. 19, 1991

[54] HAND DRIER WITH BACKWARD CURVED IMPELLER FAN

[75] Inventor: Peter W. Allen, Studley, United Kingdom

[73] Assignee: Airdri Limited, Oxford, England

[21] Appl. No.: 395,279

[22] Filed: Aug. 17, 1989

[30] Foreign Application Priority Data

Aug. 18, 1988 [GB] United Kingdom ..... 8819612.6
Jan. 26, 1989 [GB] United Kingdom ..... 8901730.5

[51] Int. Cl.[5] ..... F26B 19/00
[52] U.S. Cl. ..... 34/202; 34/90
[58] Field of Search ..... 34/202, 90, 97, 91; 417/423.7; 416/178, 182, 187; 415/206, 228, 52.1, 53.1

[56] References Cited

U.S. PATENT DOCUMENTS

| | | | |
|---|---|---|---|
| 2,438,762 | 3/1948 | McLeckie | 34/202 |
| 3,305,938 | 2/1967 | Goldstein | 34/90 |
| 3,603,002 | 9/1971 | Spierer | 34/202 |
| 3,744,149 | 7/1973 | Helbling | 34/202 |
| 4,087,925 | 5/1978 | Bienek | 34/202 |
| 4,383,377 | 5/1983 | Crafton | 34/202 |
| 4,665,630 | 5/1987 | Postbeschild | 34/202 |
| 4,707,933 | 11/1987 | Keck et al. | 34/97 |

FOREIGN PATENT DOCUMENTS

| | | | |
|---|---|---|---|
| 558602 | 12/1957 | Fed. Rep. of Germany | 34/202 |
| 436612 | 11/1967 | Switzerland | 34/202 |
| 633519 | 11/1978 | U.S.S.R. | 34/202 |

*Primary Examiner*—Henry A. Bennet
*Assistant Examiner*—Denise L. Gromada
*Attorney, Agent, or Firm*—Davis, Bujold & Streck

[57] ABSTRACT

There is provided a hand drier comprising: a rigid housing having an air inlet and an air outlet; a flow passage through the housing having the inlet as its upstream end and the outlet as its downstream end; a fan incorporated in the flow passage the fan being in the form of a backward curved multi-bladed radial flow device; a heat transfer volume incorporated in the flow passage, the volume housing a heating element; a motor mounted in the housing for driving the fan, the motor being a brushless direct current device; and control means for operating the motor and heating element. The term 'backward curved' applied to a blade refers to a blade which, when viewed along the axis of rotation of the fan, has a root from which the blade extends both outwardly and backwardly relative to a radius from the axis of rotation extending through the root. Thus relative to the direction of travel the root is the leading part of the blade and the outer end the trailing part. Among major benefits arising from the use of a brushless direct current motor are: the shape of the motor which takes the form of a cylinder with a small height by comparison with its diameter which is a convenient shape to include within a small overall heater envelope; and the achievement of a high operating speed without excessive noise generation.

7 Claims, 3 Drawing Sheets

HAND DRIER WITH BACKWARD CURVED IMPELLER FAN

This invention relates to a drier. It relates particularly, through not exclusively, to a drier for the drying of parts of the body such as hands, hands and face or hair. For brevity such a drier will hereinafter be referred to as a hand drier. Such driers are frequently used in a wall mounted form in changing rooms, cloaks rooms, business and factory premises, public wash places and the like A hand drier has to meet a number of operational requirements. The drying of recently washed hands and face needs to be completed in a reasonable time, say, thirty seconds. This requires a substantial amount of electrical power, typically 2.5 kilowatts, and a blower capable of providing an airflow of about 150 cubic feet per minute (say 70 liters per second), There is consequently a need for a mains power supply together with timing and protection devices to ensure economic and safe operation of the drier. In addition a hand drier for use in a public place needs to be designed so as to resist vandalism.

A hand drier is known having a housing containing a centrifugal multi-bladed impeller with forwardly curved blades (that is to say the blades are concave in the direction of travel). The impeller is driven by a commutator type electric motor to draw air into the housing. The in-drawn air is then heated prior to passing through the impeller and is thereafter blown from an outlet of the casing for use in drying hands or whatever placed near the outlet. Market requirements have in some significant cases lead to a need for hand drier development. These include a reduction in overall hand drier size, improved heating performance, improved noise levels or any combination of these along with other design modicications.

According to the present invention there is provided a hand drier comprising:

- a rigid housing having an air inlet and an air outlet;
- a flow passage through the housing having the inlet as its upstream end and the outlet as its downstream end;
- a fan incorporated in the flow passage, the fan being in the form of a backward curved multi-bladed radial flow device rotatable about an axis and having an outside diameter, perpendicular to the axis, which is substantially greater than the width of blades measured in a direction parallel to the axis;
- a heat transfer volume incorporated in the flow passage the volume housing a heating element;
- a motor mounted in the housing for driving the fan about the axis, the motor being a brushless direct current device having a length, measured in the direction of the axis, which is substantially less than it outside dimension is a direction perpendicular to the axis; and a control unit for regulating operation of the motor and heating element.

The term [backward curved] applied to a blade refers to a which, when viewed along the axis of rotation of the fan, has root from which the blade extends both outwardly and backwardly relative to a radius from the axis of rotation extending througn the root. Thus relative to the direction of rotation the root is the leading part of the blade and the outer end the trailing part.

The heat transfer volulme can be incorporated in the flow path either between the inlet and the fan or between the fan and the outlet.

Accordng to a first preferred form of the present invention the fan is adapted for rotation about the axis within a volute chamber and each blade extends outwardly from a root located in the vicinity of the axis to a tip located remote from the axis; and the blade width, measured in a direction parallel to axis, decreases in moving outwardly from the root to the tip location.

Preferably in a hand drier according to the first preferred form of the present invention the impeller comprises an array of blades one side of each blade in the array being mounted on a backplate; the other side of each blade in the array being mounted on an apertured plate to provide a central aperture at the root end of the blade array so that:

A. the central aperture receives air drawn along the flow passage from upstream of the fan;

B. air flow vents from the outer periphery of the array into the volute chamber; and C. an outlet from the volute chamber vents into the flow passage downstream of the fan.

In a hand drier according to the present invention or any preferred version thereof the air inlet and air outlet are juxaposed on a face of the housing the face being directed in a generally direction. This provides that the air inlet and outlet are not blocked in the event that a flexible item is draped over the mounted drier.

In a hand drier according to the present invention or any preferred version thereof the control means includes a sensor whereby positioning of an object in the vicinity of the air outlet results in the control means enabling operation of the motor and heating element. Alternatively the contol means provides for manual initiation of the heating cycle.

By using a brushless direct current motor (in contrast to the commutator type motors used in existing hand driers) and a backward curved multi-bladed radial flow fan (in contrast to the multi-bladed impeller conventionally used) advantage can be taken of their combined shapes when mounted on the axis to pack them within a relatively small overall heater envelope than achieved heretofore. In addition the relatively high operating speed of the motor enables relatively high volume flows to be achieved without the generation of excessive noise.

An exemplary embodiment of the present invention will now be described with reference to the accompanying drawings of which:

Figure 1:
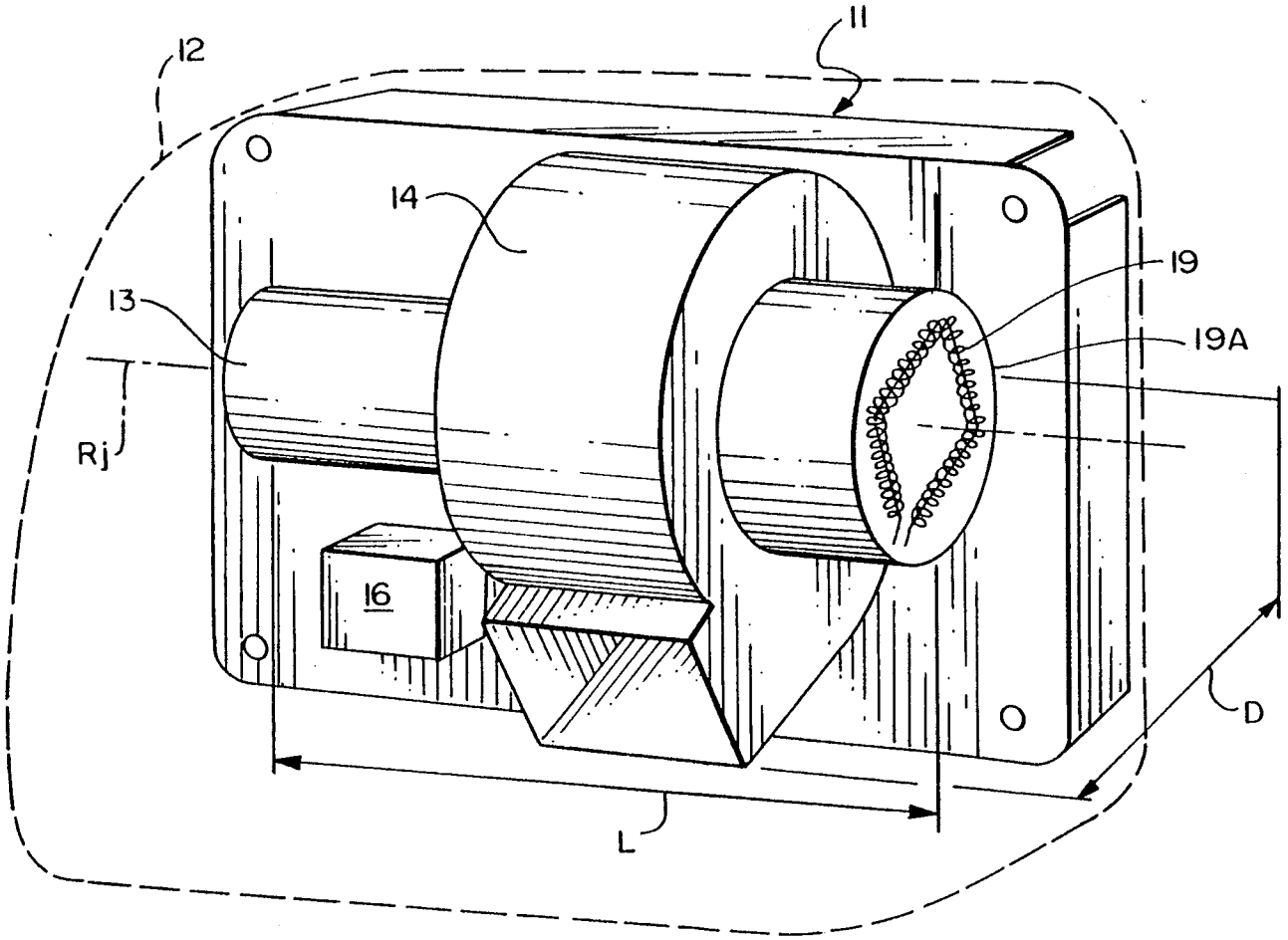
FIG. 1 shows a perspective vieew of a conventional hand drier including selected components.
Figure 2:
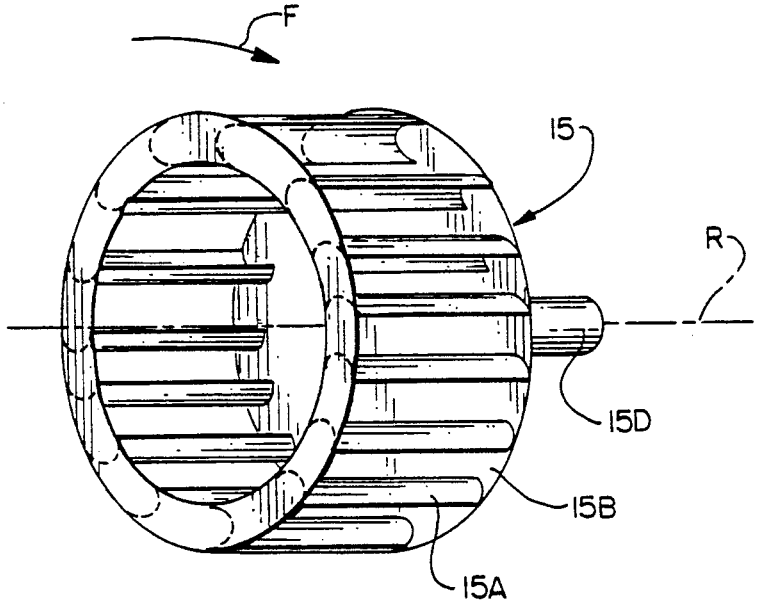
FIG. 2 shows a perspective view of a component referred to in connection with FIG. 1.

CONVENTIONAL HAND DRIER (FIGS. 1 and 2)

FIG. 1

This shows a conventional hand drier 11 having a casing 12 (shown in ghosted outline) housing an impeller (described in more detail in connection with FIG. 2), a volute chamber 14 and a conventional series wound commutator type electric motor 13 for rotating the impeller of FIG. 2 about axis R. A heating element 19 is located in heater volume 19A opening into the volute chamber 14. A control unit 16 serves to govern the period of time for which the drier operates following start up. The overall length A of the combined motor 13, volute chamber 14 and heater 19 oblige it to be mounted within the casing as shown to keep the overall depth D of the casing to that necessary to house the widest component which in this case is the outside diameter of volute chamber 14.

FIG. 2

This shows the impeller 15 mounted within volute chamber 14 of FIG. 1. The impeller 15 is made up of a series of blades 15A arranged in the form of a cylinder about the periphery of a disc 15B to define an inlet volume. The impeller is rotated by way of a shaft 15D about axis R in the direction of arrow F. The blades 15A are forwardly concave in their normal direction of travel. The impeller 15 serves to generate a pressure head to cause heated air to be driven from an outlet of the conventional drier.

Figure 6:
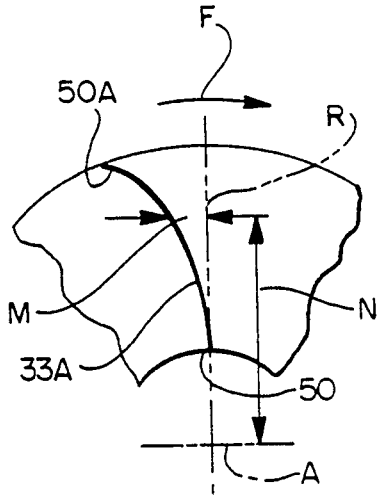
FIG. 6 is an end view of part of the impeller shown in FIG. 5 in the direction of arrow V.

Hand drier 20 has a back plate 28 having mounted on it a cover 30 (shown in ghosted outline). The back plate 28 incorporates an air inlet 31 and an air outlet 38. Heated air from outlet 38 leaves the drier casing by way of aperture 38A. The inlet 31 and outlet 38 are coupled by way of a flow passage P. A backward curved centrifugal impeller 33 (detailed in FIG. 6) is housed in a volute chamber 34 in which it is driven by a brushless DC motor 35 about axis A.

Figure 5:
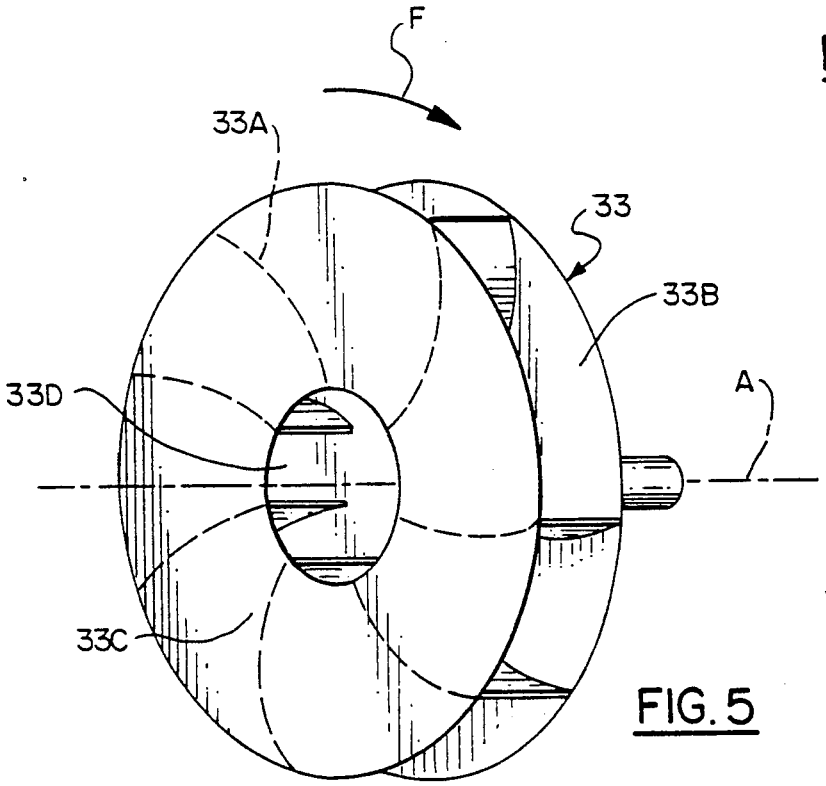
FIG. 5 is a perspective view of a component referred to in connection with FIGS. 3 and 4.

Referring now to FIG. 5 the impeller 33 has a number of blades (typically blade 33A) mounted between circular side plate 33B and annular side plate 33C to define an inlet area 33D. The impeller 33 is rotated about axis A in the direction of arrow F.

The blade 33A has a root end 50 lying on radius R from the axis A. The blade 33A extends outwardly and backwardly from the root 50 so that the rearwardly projecting perpendicular distance M (relative to the direction of rotation F) from the radius R increases with increasing radial extension N from axis A. The width of the blade 33A perpendicular to the direction of rotation can also be varied in dependence on the radial extension N. In this case the width of blade 33A decreases as the radial extension N increases.

The cross-section of the volute chamber at a given section relates to the impeller section in dependence, typically on the required pressure drop and flow rates.

Both the volute chamber 34 and the motor 35 are characterised by a much reduced axial width in the direction of axis A by comparsion with the corresponding components described in connection with FIG. 1.

The impeller 33 serves to draw air into the flow passage P by way of inlet 31, through volume 36A where it is heated by means of element 36 and into chamber 34 by way of inlet I. Air passage into inlet area 33D of the impeller is thereafter pressurized by being flung outwardly as the impeller rotates resulting in the air passing out of the chamber 34 through outlet 38 and thereafter from the drier by way of aperture 38A.

Control unit 39 incorporates an infra-red sensor directed towards region 40 beneath the drier. In the event of a hand or body portion being introduced into region 40 the heater element 36 and motor 35 are energized and the drier is caused to operate for a predetermined period governed by means of the control unit 39. Safety devices can be included such as a sensor adapted to cut off heater power in the event that overheating is detected (such as can aris from fan failure or other flow path restriction or blockage). In an alternative version the control unit provides for simple manual operation.

Figure 4:
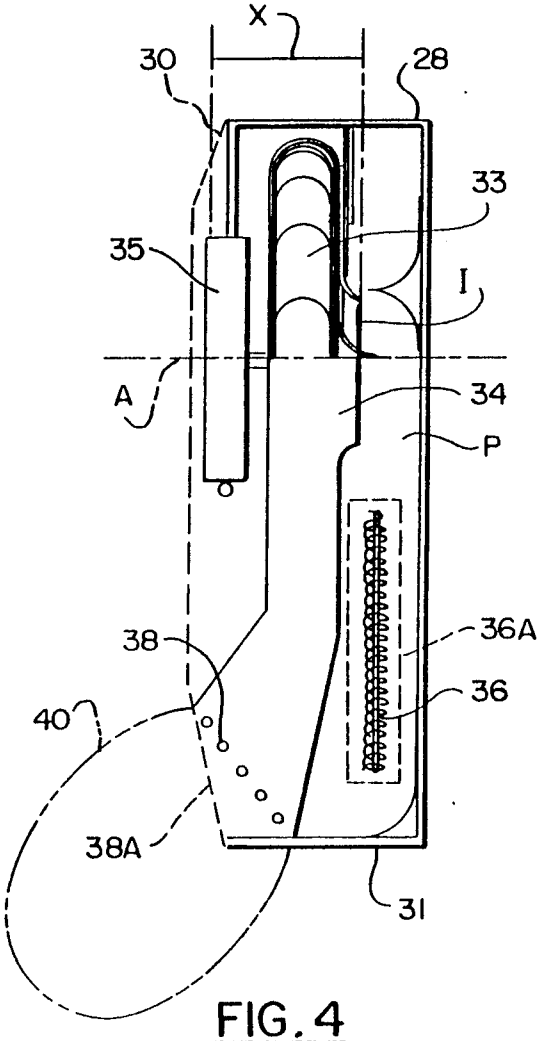
FIG. 4 is a side elevation taken on section IV—IV of FIG. 2.
Figure 3:
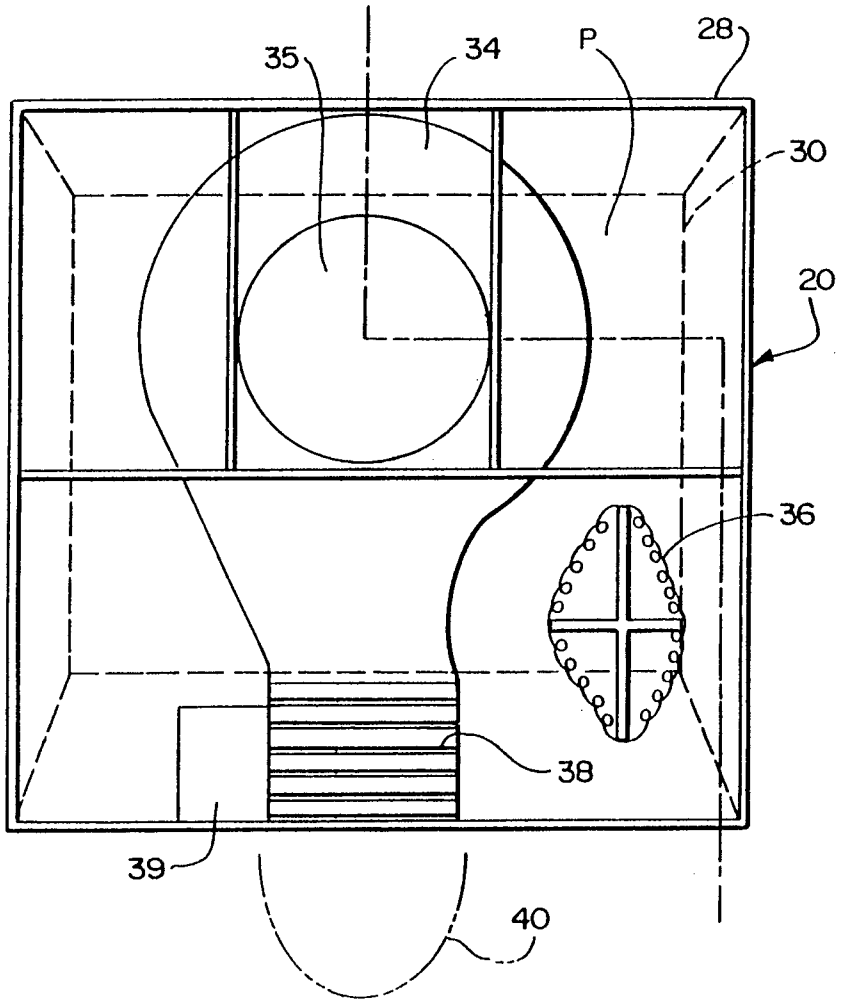
FIG. 3 shows a front elevation of a part of a hand drier according to the present invention.

It will be apparent the overall depth X of the combined motor 35, chamber 34 is substantially less than depth D of the corresponding components described in connection with FIG. 2. Indeed in addition to a reduction in casing depth the general compactness of the combined motor, chamber and shroud shown in FIG. 4 provide for a reduction in the overall height and width of the casing in comparsion with existing driers quite apart from other operational benefits such as reduced noise.

I claim

1. A hand drier comprising: a rigid housing having an air inlet and an air outlet, a flow passage extending through the housing having as an upstream end the air inlet and as a downstream end the air outlet, an impeller located in the flow passage and rotatable about an axis for conveying air from the air inlet to the air outlet, a heating means located in the flow passage, a motor for driving the impeller, and control means for operating the motor and heating means; wherein the impeller is in the form of a backward curved multi-bladed radial flow device having an outside diameter relative to said axis which is substantially greater than the width of its blades measured in a direction parallel to said axis; and the motor is a brushless direct current device having a length, measured in the direction of said axis, which is substantially less than its overall width in a direction perpendicular to said axis.

2. A hand drier as claimed in claim 1, wherein the heating means is a heater element located in the flow passage between the air inlet and the impeller.

3. A hand drier as claimed in claim 1, wherein the heating means is a heater element located in the flow passage between the impeller and the outlet.

4. A hand drier as claimed in claim 1, wherein the impeller is adapted for rotation about said axis within a volute housing with each of the impeller blades extending outwardly from a root located in the vicinity of said axis, to a tip remote from said axis; and the width of each of these blades, measured in a direction parallel to said axis, decreases from the root to the tip.

5. A hand drier as claimed in claim 4, wherein the blades of the impeller are mounted between a circular side plate and an annular side plate defining a central aperture to supply air drawn along the flow passage from upstream of the impeller to the roots of the blades;

the side plates together defining a downstream air flow exit at the tips of the blades venting into volute housing; and an outlet defined by the volute housing venting into the flow passage downstream of the impeller.

6. A hand drier as claimed in claim 1, wherein the air inlet and the air outlet are juxaposed on a face of the rigid housing and this housing is adapted for mounting so that said face, and so the inlet and outlet, may be directed in a generally downward directon.

7. A hand drier as claimed in claim 1, wherein the control means includes a sensor to detect an object in the region of the air outlet to activate the control means to operate the motor and heating means.

* * * * *